US009636837B2

(12) United States Patent
Kandemir

(10) Patent No.: US 9,636,837 B2
(45) Date of Patent: May 2, 2017

(54) ANVIL ROLL SYSTEM AND METHOD

(71) Applicant: The Procter & Gamble Company, Cincinnati, OH (US)

(72) Inventor: Mujdat Kandemir, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/517,950

(22) Filed: Oct. 20, 2014

(65) Prior Publication Data

US 2015/0033926 A1 Feb. 5, 2015

Related U.S. Application Data

(62) Division of application No. 13/051,368, filed on Mar. 18, 2011, now Pat. No. 8,863,627.

(51) Int. Cl.

| | |
|---|---|
| ***B26D 1/22*** | (2006.01) |
| ***B26D 3/08*** | (2006.01) |
| ***B26D 7/20*** | (2006.01) |
| ***B26D 7/26*** | (2006.01) |
| ***B26D 1/28*** | (2006.01) |
| *B26F 1/38* | (2006.01) |
| *B26D 1/40* | (2006.01) |

(52) U.S. Cl.

CPC ..... *B26D 7/204* (2013.01); *B26D 1/285* (2013.01); *B26D 1/405* (2013.01); *B26D 7/265* (2013.01); *B26D 1/40* (2013.01); *B26F 1/384* (2013.01); *Y10T 83/0605* (2015.04); *Y10T 83/4838* (2015.04)

(58) Field of Classification Search

CPC ..... B26D 7/204; B26D 1/405; B26D 1/40; B26D 7/265; B26D 1/285; B26F 1/384; Y10T 83/0605; Y10T 83/4838

USPC ..... 83/56, 346, 13, 345, 660, 344, 669, 659, 83/658, 663

See application file for complete search history.

(56) References Cited

U.S. PATENT DOCUMENTS

| | | | |
|---|---|---|---|
| 3,152,501 | A | 10/1964 | Nassar |
| 4,095,498 | A | 6/1978 | Biggar, III |

(Continued)

FOREIGN PATENT DOCUMENTS

| | | |
|---|---|---|
| EP | 1 710 059 A1 | 10/2006 |
| GB | 2 273 287 A | 6/1994 |

OTHER PUBLICATIONS

PCT/US2012/026209 PCT International Search Report, 7 pages.

*Primary Examiner* — Ghassem Alie

(74) *Attorney, Agent, or Firm* — Charles R. Matson

(57) ABSTRACT

The disclosure concerns a rotary cutting apparatus having a frame and a die roll defining a first longitudinal axis and having a cutting member. The die roll is rotatably connected with the frame and configured to rotate about the first longitudinal axis. The rotary cutting apparatus further has a bearer ring connected with the die roll and an anvil roll defining a second longitudinal axis and having an outer radial surface. The anvil roll is rotatably connected with the frame and is configured to rotate about the second longitudinal axis. The bearer ring of the die roll is in contact with the outer radial surface. The anvil roll may be supported by at least one cam follower. The anvil roll may be axially removable from the frame via lateral translation along the second longitudinal axis.

16 Claims, 9 Drawing Sheets

(56) References Cited

U.S. PATENT DOCUMENTS

| | | | | | |
|---|---|---|---|---|---|
| 4,289,055 | A | | 9/1981 | Von Schriltz | |
| 4,413,541 | A | | 11/1983 | Biggar, III | |
| 4,553,461 | A | * | 11/1985 | Belongia | 83/344 |
| 4,597,317 | A | | 7/1986 | Heyden | |
| 4,641,558 | A | | 2/1987 | Hoffmann | |
| 4,698,052 | A | | 10/1987 | Slobodkin | |
| 4,759,247 | A | | 7/1988 | Bell et al. | |
| 4,770,078 | A | | 9/1988 | Gautier | |
| 4,793,229 | A | | 12/1988 | Kleber | |
| 4,881,936 | A | | 11/1989 | Slobodkin | |
| 5,174,185 | A | * | 12/1992 | Aichele | 83/346 |
| 5,388,490 | A | | 2/1995 | Buck | |
| 5,598,758 | A | | 2/1997 | Chmelar | |
| 5,775,193 | A | | 7/1998 | Pratt | |
| 5,842,399 | A | | 12/1998 | Pfaff, Jr. | |
| 5,915,644 | A | | 6/1999 | Prittie | |
| 6,110,999 | A | | 8/2000 | Ourth et al. | |
| 7,000,517 | B1 | | 2/2006 | Spix et al. | |
| 7,060,016 | B2 | | 6/2006 | Cipolli | |
| 7,299,729 | B2 | * | 11/2007 | Cox | 83/343 |
| 2002/0180113 | A1 | | 12/2002 | Sullivan | |
| 2003/0010433 | A1 | | 1/2003 | Williamson | |
| 2006/0011030 | A1 | | 1/2006 | Wagner et al. | |
| 2006/0048616 | A1 | | 3/2006 | Grenier et al. | |
| 2006/0243111 | A1 | | 11/2006 | Grenier | |
| 2006/0248999 | A1 | * | 11/2006 | Monteil | 83/469 |
| 2007/0101844 | A1 | | 5/2007 | Spilker | |
| 2009/0272240 | A1 | | 11/2009 | Böhm et al. | |
| 2011/0048622 | A1 | | 3/2011 | Yamamoto | |

* cited by examiner

ANVIL ROLL SYSTEM AND METHOD

CROSS REFERENCE TO RELATED APPLICATION

This application is a divisional of application Ser. No. 13/051,368 filed on Mar. 18, 2011, which is incorporated herein by reference.

FIELD OF THE INVENTION

The present disclosure relates generally to rotary cutting apparatuses and, more particularly, relates to methods and apparatuses using anvil roll having a relatively small diameter and being laterally removable from a frame to allow online replacement.

BACKGROUND OF THE INVENTION

Rotary cutting apparatuses can comprise a frame, a die roll rotatably mounted to the frame, and an anvil roll rotatably mounted to the frame. The die roll can comprise at least one cutting member for cutting and creasing material against an anvil roll when the material is passed between the die roll and the anvil roll. As the cutting member on the die roll cuts the material, an outer surface of the anvil roll may wear owing to the pressure applied by the cutting member to the outer surface of the anvil roll. Eventually, the anvil roll may need to be replaced after a sufficient amount of the outer surface of the anvil roll has been worn away. Additionally, as the die roll engages the anvil roll, undesirable deflection in the anvil roll may occur. In order to help reduce this deflection, anvil rolls may be used that have a relatively large diameter. With the increase of diameter, however, the overall mass of the anvil roll is also increased. As the size of the anvil roll increases, difficulties in controlling the rotation of the anvil roll may result. For instance, as the mass of the anvil roll increases, it is typically more difficult to start, stop, or otherwise control the rotation of the anvil roll. Anvil rolls having a larger diameter may also be relatively expensive to manufacture and/or refurbish.

The process of replacing a large anvil roll can be time consuming since many components of the rotary cutting apparatus must be disassembled to access the anvil roll. A production line relying on the rotary cutting apparatus may have to be down for an extended period of time which could result in an undesirable loss in production. Additionally, due to the mass of the anvil roll, removing the anvil roll from the rotary cutting apparatuses and/or handling the anvil roll may require additional manpower and/or mechanical assistance. In view of the importance of anvil roll maintenance and/or the cost of anvil roll replacement, this technology should be improved.

SUMMARY OF THE INVENTION

In one non-limiting embodiment of the present disclosure, a rotary cutting apparatus comprises a frame and a die roll defining a first longitudinal axis and having an outer circumferential portion comprising a cutting member. The outer circumferential portion has a maximum outer diameter and the die roll is rotatably connected with the frame and configured to rotate about the first longitudinal axis. The rotary cutting apparatus further comprises a bearer ring connected with the die roll and an anvil roll defining a second longitudinal axis. The anvil roll has an outer circumferential surface and the anvil roll is rotatably connected with the frame and is configured to rotate about the second longitudinal axis. The anvil roll is positioned relative to the die roll such that the bearer ring is in contact with the outer circumferential surface such that the first longitudinal axis is substantially parallel with the second longitudinal axis. The anvil roll has a maximum outer diameter and the maximum outer diameter of the outer circumferential portion of the die roll is at least twice the maximum diameter of the anvil roll. The rotary cutting apparatus further comprises a first bearing block and a second bearing block, with the first and second bearing blocks receiving respective first and second ends of the anvil roll. The anvil roll is selectively removable from the frame and the bearing blocks via translation along the second longitudinal axis.

In another non-limiting embodiment of the present disclosure, a rotary cutting apparatus comprises a frame and a die roll. The die roll defines a first longitudinal axis and has an outer circumferential portion comprising a cutting member. The outer circumferential portion has a maximum outer diameter. The die roll is rotatably connected with the frame and configured to rotate about the first longitudinal axis. The rotary cutting apparatus further comprises a bearer ring connected with the die roll. The rotary cutting apparatus further comprises an anvil roll defining a second longitudinal axis and comprising an outer circumferential surface. The anvil roll is rotatably connected with the frame and is configured to rotate about the second longitudinal axis. The anvil roll is positioned relative to the die roll such that the bearer ring is in contact with the outer circumferential surface such that the first longitudinal axis is substantially parallel with the second longitudinal axis. The anvil roll has a maximum outer diameter, wherein the maximum outer diameter of the outer circumferential portion of the die roll is at least twice the maximum diameter of the anvil roll. The rotary cutting apparatus further comprises a cam follower having a cam follower axis. The cam follower is in supporting contact with the anvil roll and configured to rotate about the cam follower axis when the anvil roll rotates.

In yet another non-limiting embodiment of the present disclosure, a method of cutting a web of material is provided. The method comprises the steps of advancing a web of material in a machine direction directly from a first conveyer into a nip of a rotary cutting apparatus and rotating a die roll, the die roll defining a first longitudinal axis and having an outer circumferential portion comprising a cutting member. The outer circumferential portion has a maximum outer diameter and the die roll is rotatably connected with a frame and configured to rotate about the first longitudinal axis. The method further comprises the steps of rotating an anvil roll, the anvil roll defining a second longitudinal axis and comprising an outer circumferential surface. The anvil roll is rotatably connected with the frame and is configured to rotate about the second longitudinal axis, the anvil roll positioned relative to the die roll such that the first longitudinal axis is substantially parallel with the second longitudinal axis. The anvil roll has a maximum outer diameter. The maximum outer diameter of the outer circumferential portion is at least twice the maximum diameter of the anvil roll. The method comprises the steps of supporting the anvil roll with a rotatable cam follower in frictional contact with the anvil roll, cutting at least a portion of the web of material with the cutting member, and advancing the web of material in a machine direction directly from the nip to a second conveyor.

DETAILED DESCRIPTION OF THE INVENTION

Figure 1:
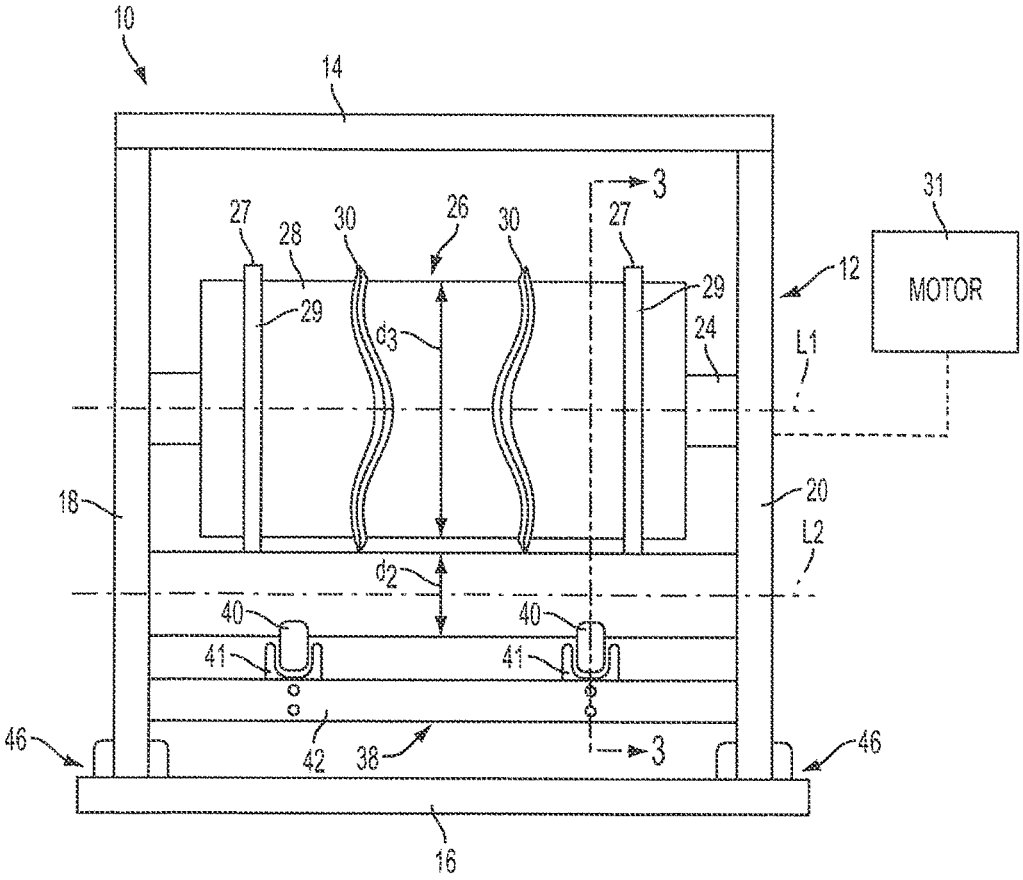
FIG. 1 is a perspective view of a rotary cutting apparatus according to one non-limiting embodiment.

Various non-limiting embodiments of the present disclosure will now be described to provide an overall understanding of the principles of the structure, function, manufacture, and use of the apparatuses and methods disclosed herein. One or more examples of these non-limiting embodiments are illustrated in the accompanying drawings. Those of ordinary skill in the art will understand that the apparatuses and methods specifically described herein and illustrated in the accompanying drawings are non-limiting example embodiments and that the scope of the various non-limiting embodiments of the present disclosure are defined solely by the claims. The features illustrated or described in connection with one non-limiting embodiment may be combined with the features of other non-limiting embodiments. Such modifications and variations are intended to be included within the scope of the present disclosure.

The present disclosure provides rotary cutting apparatuses and methods utilizing an anvil roll having a relatively small diameter and being laterally removable from a frame. More specifically, the apparatuses and methods may be useful for providing added control to the anvil roll, decreased deflection of the anvil roll, and online changeability. Those of ordinary skill in the art will recognize other suitable uses for the apparatuses and methods of the present disclosure.

In general, a rotary cutting apparatus may comprise a frame, a die roll assembly rotatably attached to the frame, and an anvil roll assembly rotatably attached to the frame. The die roll assembly may comprise a die roll and the anvil roll assembly may comprise an anvil roll. The die roll assembly may also comprise at least one cutting member configured to be forced against the anvil roll, as the anvil roll rotates relative to the die roll, to cut a material being fed through the nip of the die roll and the anvil roll. The force of the cutting member on an outer surface of the anvil roll can cause the outer surface of the anvil roll to wear over time, thereby reducing the diameter of the anvil roll. Eventually, due to wear on the anvil roll, the anvil roll will need to be replaced and/or reconditioned. Additionally, due to the cutting member exerting force upon the anvil roll, the anvil roll may tend to deflect away from the force. Such deflection may lead to degradation in the cutting function of the rotary cutting apparatus.

In accordance with various embodiments, a rotary cutting apparatus is described having an anvil roll that is laterally removable from the frame. The anvil roll may be removable without necessarily needing to remove the die roll assembly from the frame. Additionally, the anvil roll may be sized such that it can be handled by a single person. In some embodiments, the anvil roll may be supported by one or more rolling members to decrease deflection of the anvil roll during operation of the rotating cutting apparatus. The anvil roll may be supported by thrust bearings that apply axial pressure to either end of the anvil roll. In one embodiment, spring loaded bolts, or other biasing elements are used to supply the axial pressure to the thrust bearings. Due to the axial support of the anvil roll, the configuration of the thrust bearings may help to reduce deflection of the anvil roll during operation of the rotary cutting apparatus.

In one embodiment, referring to FIG. 1, a rotary cutting apparatus 10 may comprise a frame 12 comprising a top plate 14, a bottom plate 16, a first side plate 18, and/or a second side plate 20, for example. As is to be appreciated, various components have been removed, or otherwise simplified, for clarity. The first side plate 18 and the second side plate 20 may be connected to the top plate 14 and the bottom plate 16 through any methods known in the art, such as bolting, screwing, and/or welding, for example. The bottom plate 16 of the frame 12 may be mounted to a surface or a rigid member to maintain the frame 12 of the rotary cutting apparatus 10 in a fixed position for operation. The mounting of the frame 12 may be accomplished through any methods known in the art, such as bolting, screwing, and/or welding, for example.

Figure 2:
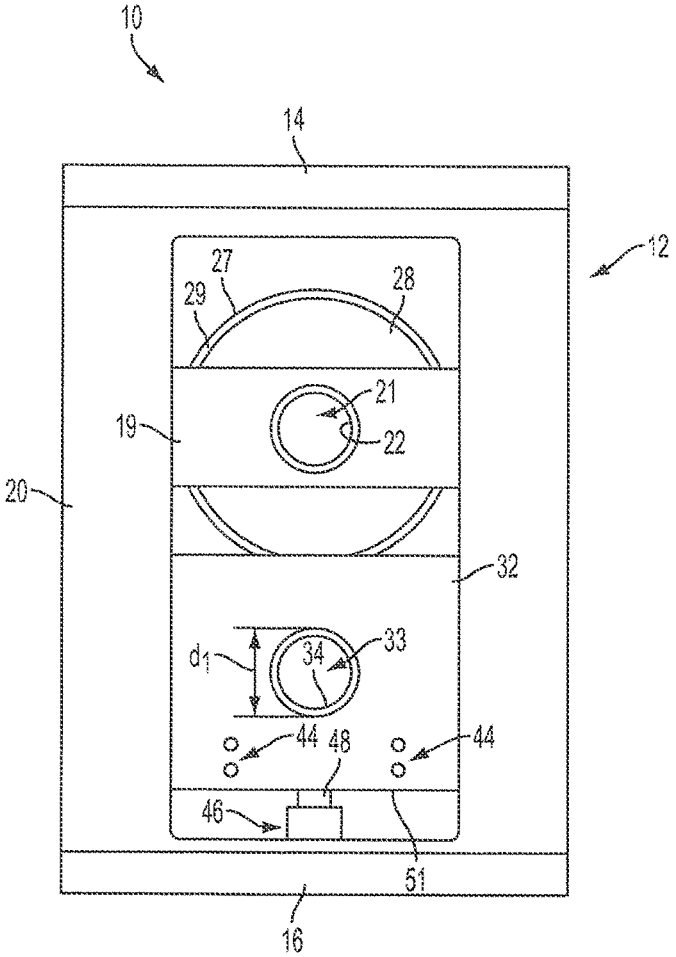
FIG. 2 is a side view of the rotary cutting apparatus of FIG. 1.
Figure 3:
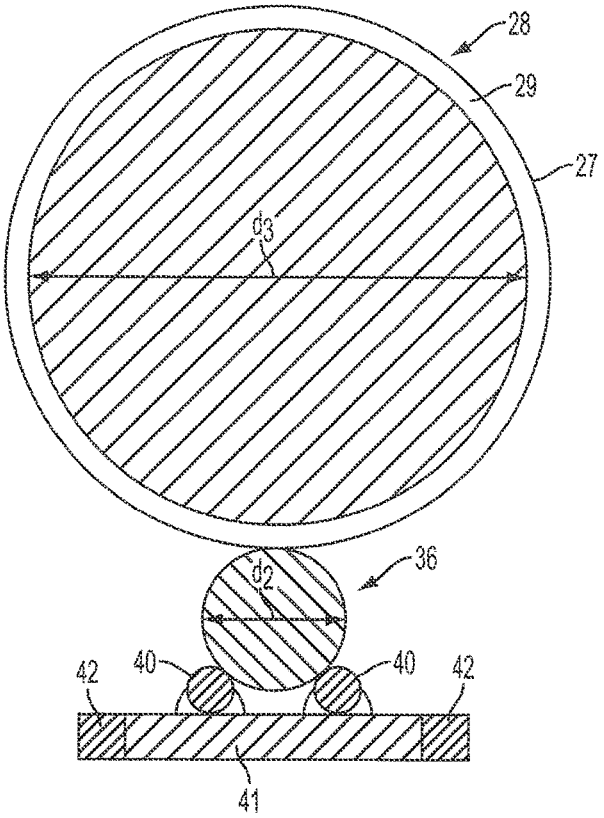
FIG. 3 is a cross-sectional view of the rotary cutting apparatus in FIG. 1 taken along line 3-3.

FIG. 2 shows a side view of one embodiment of the rotary cutting apparatus 10. FIG. 3 is a cross-sectional view of the rotary cutting apparatus 10 in FIG. 1 taken along line 3-3. Referring to FIGS. 1-3, the side plate 20 of the frame 12 may house a die bearing block 19. As is to be appreciated, the die bearing block 19 may be coupled to the frame 12, as illustrated, or the die bearing block 19 may be integral with the side plate 20. In any event, the die bearing block 19 may define an opening 21, which may receive bearings 22 for accepting a shaft 24 of a die roll assembly 26. The bearings 22 may be any suitable rotary bearing. As is to be appreciated, the side plate 18 may house a die bearing block that defines a similar opening (not shown). The die roll assembly 26 may comprise a die roll 28. Cutting member or knives 30 may be positioned on the die roll 28. The die roll 28 may also comprise one or more bearer rings 29 radially protruding from the surface of the die roll 28. The bearings 22 may be configured to move relative to the frame 12 to allow the die roll 28 to rotate relative to the frame 12 along a longitudinal axis (L1).

The side plate 20 of the frame 12 may also house an anvil bearing block 32. As is to be appreciated, the anvil bearing block 32 may be coupled to the frame 12, as illustrated, or the anvil bearing block 32 may be integral with the side plate 20. In any event, the anvil bearing block may define an opening 33, which may receive bearings 34 for accepting an anvil roll 36 of an anvil roll assembly 38. The bearings 34 may be configured to move relative to the frame 12 to allow the anvil roll 36 to rotate relative to the frame 12 along a longitudinal axis (L2). In some embodiments, the bearer rings 29 of the die roll 28 are used to deliver rotational energy from the die roll 28 to the anvil roll 36 through a frictional engagement with an outer radial surface of the anvil roll 36. In such an embodiment, the anvil roll 36 can be considered a "walking" anvil roll.

The bearings 34 may be any suitable rotary bearing. As is to be appreciated, bearings 34 may be coupled to each end of the anvil roll 36. In one embodiment, the bearings 34 are thrust bearings, such as ball thrust bearings, roller thrust bearings, or tapered roller bearings, for example. The thrust bearings may apply axial pressure to either end of the anvil roll 36. In one embodiment, spring loaded bolts, or other biasing elements, such as a disc spring 158 (FIG. 6) are used to supply the axial pressure to the thrust bearings.

As illustrated in FIGS. 1 and 2, the opening 33 in the anvil bearing block 32 may be circular and have an inner diameter (indicated by $d_1$) and the anvil roll 36 may have an outer diameter (indicated by $d_2$), where $d_1 \geq d_2$. As discussed in more detail below, the anvil roll 36 may be translated along the longitudinal axis (L2) through the opening 33. In other embodiments, the opening 33 may be oblong, rectangular, or any other suitable shape that has an opening dimensioned to allow the anvil roll 36 to pass therethrough.

In one embodiment, still referring to FIGS. 1 and 2, the longitudinal axis L1 of the die roll 28 may be parallel to, or substantially parallel to, the longitudinal axis L2 of the anvil roll 36. In one embodiment, the anvil roll 36 may be formed from a single rigid piece of material or may be formed with a center portion and a surface material at least partially surrounding the center portion. In one embodiment, the anvil roll 36 may comprise tungsten carbide, tool steel, and/or any other suitable materials for forming an anvil roll 36. In various embodiments, the outer radial surface may comprise a material positioned on the anvil roll 36 or integrally formed with the anvil roll 36, such as tungsten carbide, tool steel, and/or any other suitable material for forming the outer radial surface of the anvil roll 36.

In one embodiment, referring to FIG. 1, the die roll 28 may be driven by a motor assembly, schematically shown by motor assembly 31. The motor assembly 31 may comprise a power source and any suitable motor or other device for imparting a rotation upon a shaft 24. The motor assembly 31 may be configured to be engaged with the shaft 24 of the die roll assembly 26 through any suitable means, such as a drive shaft (not shown). The motor assembly 31 may rotate the outer surface 27 of the bearer rings 29, owing to the engagement of the bearer rings 29 with the die roll 28, at a first speed. The outer surface 27 of each of the bearer rings 29 may be configured to engage the outer radial surface of the anvil roll 36 to drive the anvil roll 36 owing to frictional engagement between the outer surface 27 of the bearer rings 29 and the outer radial surface of the anvil roll 36. In one embodiment, the outer radial surface of the anvil roll 36 can then rotate at a second speed. The speed of the outer surface 27 of the bearer rings 29 may be the same as or substantially the same as the speed of the outer radial surface of the anvil roll 36. In other embodiments, the drive shaft of the motor assembly 31 may be used to drive the anvil roll 36 by conventional methods.

Referring to FIGS. 1-3, the anvil roll assembly 38 may comprise one or more cam followers 40 in contact with the anvil roll 36. The cam followers 40 may be disposed in any suitable configuration. While two sets of cam followers 40 are illustrated in FIG. 1, it is to be appreciated that this disclosure is not so limited. Generally, the cam followers 40 may contact the anvil roll 36 to help bear the load of the die roll 28 and decrease the deflection of the anvil roll 36. In one embodiment, the cam followers 40 are coupled to a cam frame 41. The cam frame 41 may be coupled to a cross support frame 42 that spans the frame 12. In some embodiments, the cam frame 41 is integral with the cross support frame 42. The cross support frame 42 may be coupled to the anvil bearing block 32 via connections 44.

In one embodiment, referring to FIGS. 1 and 2, the anvil roll assembly 38 may be movably connected with the frame 10 to allow a distance between an outer surface of the anvil roll 36 and cutting members 30 located on the die roll 28 to be increased and/or decreased. The cutting members 30 may be configured to be rotated about the longitudinal axis L1 in an orbital path. The distance between the cutting members 30 and the outer surface of the anvil roll 36 may be controlled using an adjustment assembly 46. In one embodiment, more than one adjustment assembly may be used. In the embodiment illustrated in FIGS. 1 and 2, two adjustment assemblies 46 are used by the rotary cutting apparatus 10. The adjustment assemblies 46 may be coupled to intermediate side plates 18 and 20 of the frame 10 (see FIG. 2) and may be configured to adjust the distance between the orbital path of the cutting members 30 positioned on the die roll 28 and the outer radial surface of the anvil roll 36. For example, the adjustment assemblies 46 may be mounted to each side plate 18, 20 of the frame 10 and may be configured to move the bearings 34 of the anvil roll assembly 38 either towards or away from bearings 22 of the die roll assembly 26. In one embodiment, the adjustment assembly 46 is a pneumatic bellows which may be engaged with a surface 51 of the anvil bearing block 32. In some embodiments, the adjustment assembly 46 may additionally/alternatively apply force to other components of the anvil roll assembly, such as the cross support frame 42, for example. The force applied by the adjustment assembly 46 to the anvil bearing block 32 may be used to push the anvil roll assembly 38 towards the die roll assembly 26 to provide the proper amount of cutting force to cutting members 30 of the die roll 28.

As illustrated in FIG. 3, the die roll 28 may have an outer diameter (indicated by d3). In some embodiments, the outer diameter d3 is at least greater than about 1.5 times the outer diameter d2. In some embodiments, the outer diameter d3 is at least greater than about 2 times the outer diameter d2. In some embodiments, the outer diameter d3 is at least greater than about 2.5 times the outer diameter d2. In some embodiments, the outer diameter d3 is at least greater than about 3 times the outer diameter d2. In some embodiments, the outer diameter d3 is at least greater than about 3.5 times the outer diameter d2. In some embodiments, the outer diameter d3 is at least greater than about 4 times the outer diameter d2. In one embodiment, the outer diameter d3 is about 200 mm to about 300 mm and the outer diameter d2 is about 50 mm to about 100 mm, although this disclosure is not so limited.

In one embodiment, the material being cut and/or creased by the rotary cutting apparatus 10 may be a web configured for use in fabricating absorbent articles, such as diapers, training diapers, pull-up pants, incontinence briefs, and undergarments, for example. In various other embodiments, the material being cut may comprise any material that may be processed by a rotary cutting apparatus, such as corrugated plastic, corrugated fiberboard, card stock, and/or any other suitable material.

Figure 4:
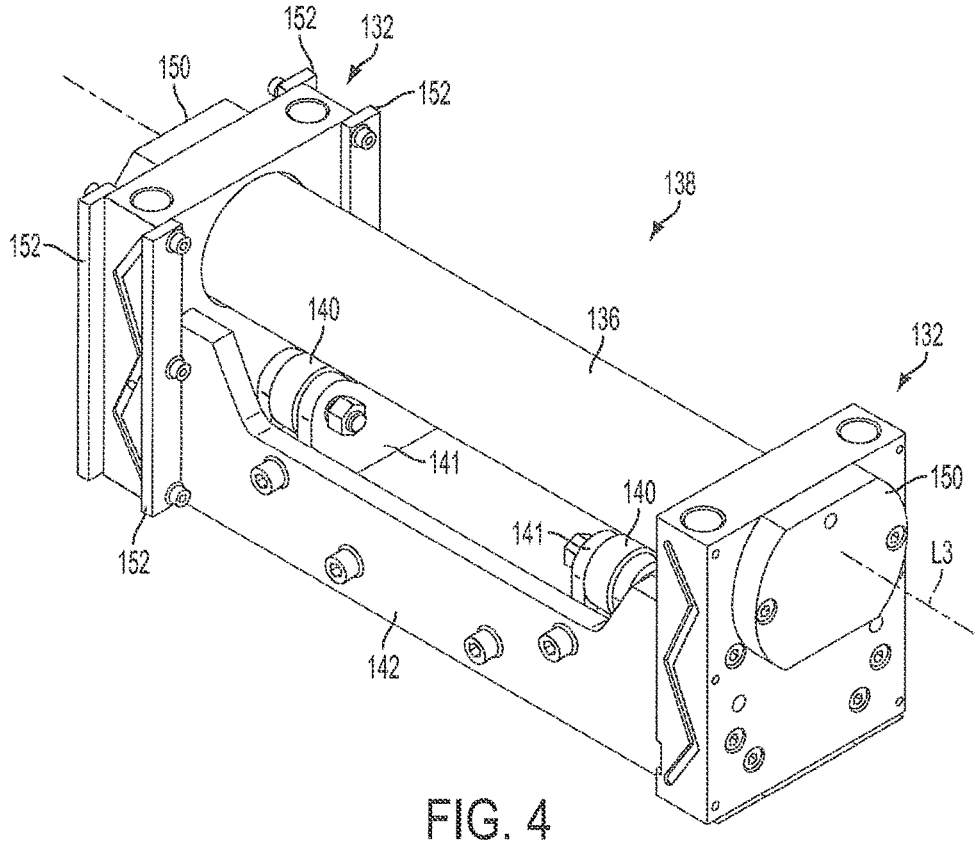
FIG. 4 is a perspective view of one embodiment of an anvil roll assembly according to one non-limiting embodiment.
Figure 5:
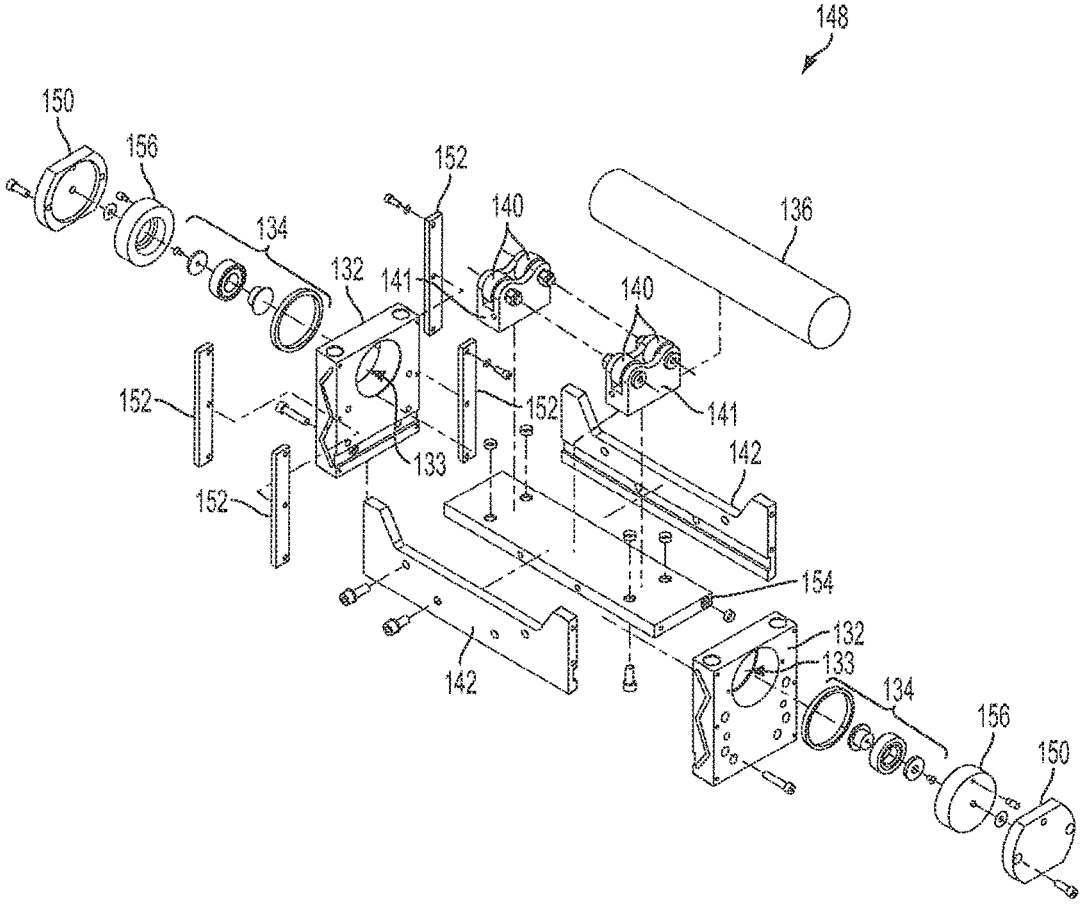
FIG. 5 is an exploded view of the anvil assembly of FIG. 4.

FIG. 4 is a perspective view of one embodiment of an anvil roll assembly 138. FIG. 5 is an exploded view of the anvil assembly 138 of FIG. 4. Unless otherwise indicated, the components with corresponding reference numerals (e.g., 36, 136) can have the same or a similar structure and function as discussed above with respect to other embodiments. As such, these components will not be discussed in detail again, with respect to the anvil roll assembly 138, for the sake of brevity. The anvil roll assembly 138 may comprise bearing caps 150 that may be removably coupled to the anvil bearing blocks 132 using any suitable attachment technique. The bearing caps 150 may assist in retaining the bearing housing 156 and the thrust bearings 134. As discussed in more detail below, in order to remove the anvil roll 136 from the anvil roll assembly 138, one or both of the bearing caps 150 may be removed from the anvil bearing blocks 132 to allow access to the anvil roll 136. Still referring to FIGS. 4 and 5, at least one frame brace 152 may be also be coupled to the bearing block 132. The frame braces 152 may be used to slidingly couple the anvil roll assembly 138 to a frame (such as frame 12 in FIG. 1). In other embodiments, other techniques may be used to secure the anvil roll assembly 138 to the frame. As shown in FIG. 5, the cam frames 141 may be mounted to a bottom cross frame 154, which may be coupled to the anvil bearing blocks 132.

Figure 6:
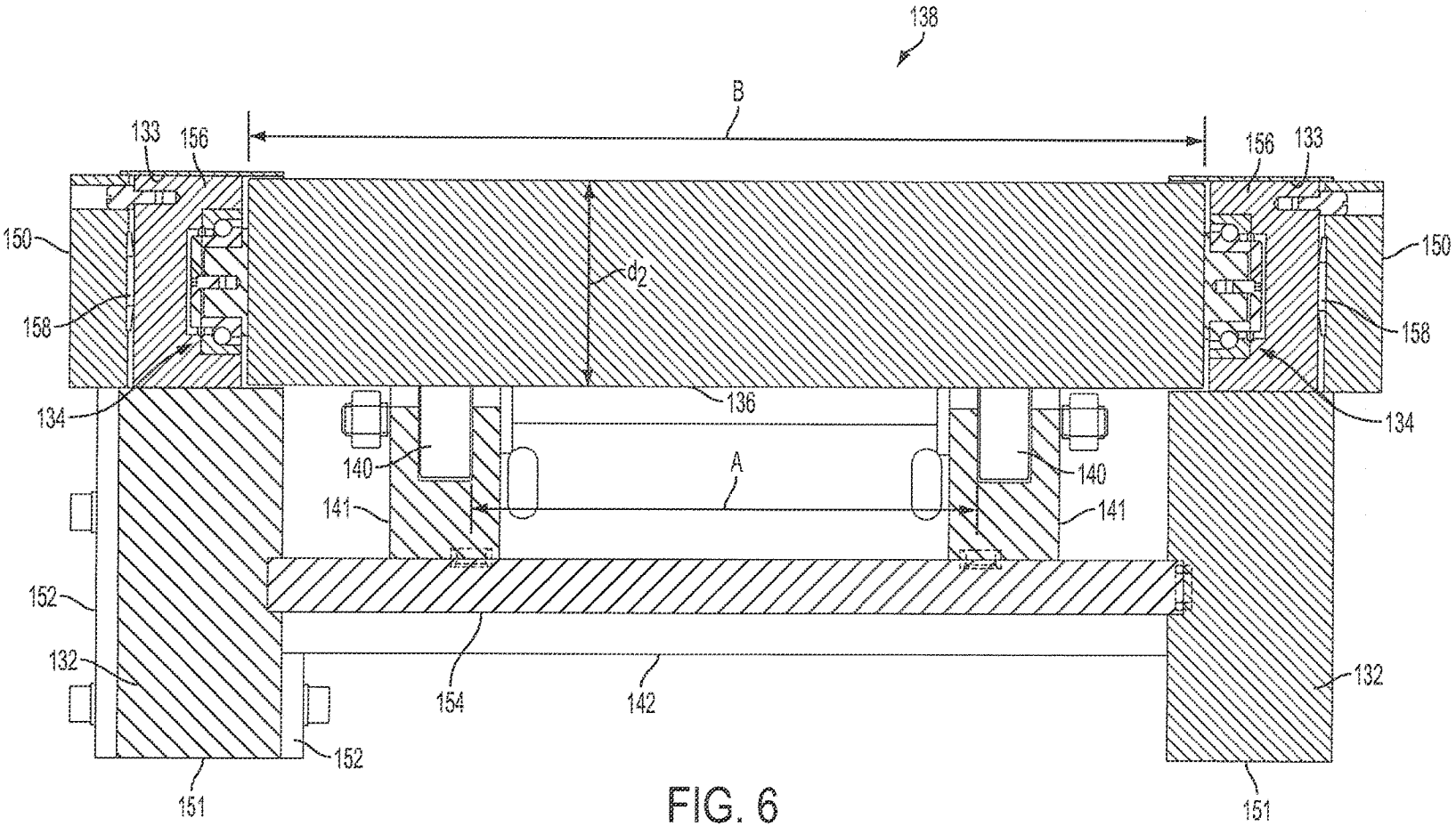
FIG. 6 is a cross-sectional view of the anvil roll assembly of FIG. 4 taken along a longitudinal axis.

FIG. 6 is a cross-sectional view of the anvil roll assembly 138 of FIG. 4 taken along the longitudinal axis L3. As illustrated, thrust bearings 134 may permit axial rotation of the anvil roll 136 and may be positioned within the opening 133 of the anvil bearing blocks 132. The anvil roll assembly 138 may comprise a disc spring 158, or other biasing element (e.g., a spring-loaded bolt), to maintain the position of the anvil roll 136 during operation. In one embodiment, as shown in FIG. 6, the disc spring 158 is positioned in between the bearing cap 150 and the bearing housing 156. The illustrated embodiment shows two sets of cam followers 140 separated by a distance of A used to support the anvil roll 136. In one embodiment A is about 50 mm to about 75 mm, although the disclosure is not so limited. The anvil roll 136 has a longitudinal length of B. In one embodiment, B is about 300 mm to about 400 mm and diameter d2 is about 50 mm to about 100 mm, although the disclosure is not so limited. In some embodiments, the cam followers 140 are positioned along the anvil roll 136 below where the bearing rings 29 (FIG. 1) contact the anvil roll 136.

Figure 7A:
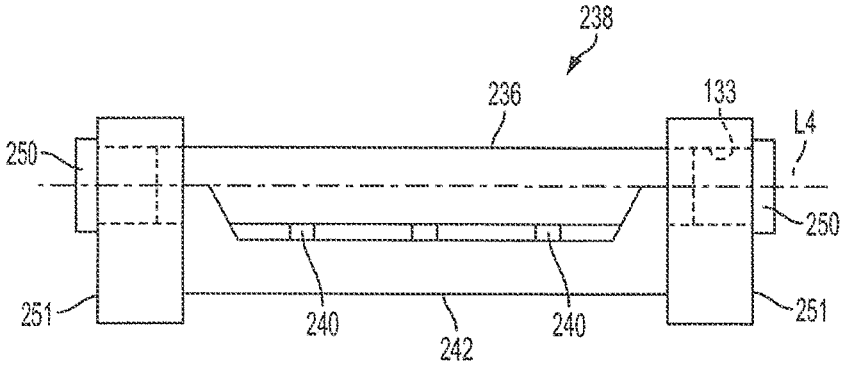
FIGS. 7A-B show the axial translation of an anvil roll along its longitudinal axis according to one non-limiting embodiment.
Figure 7B:
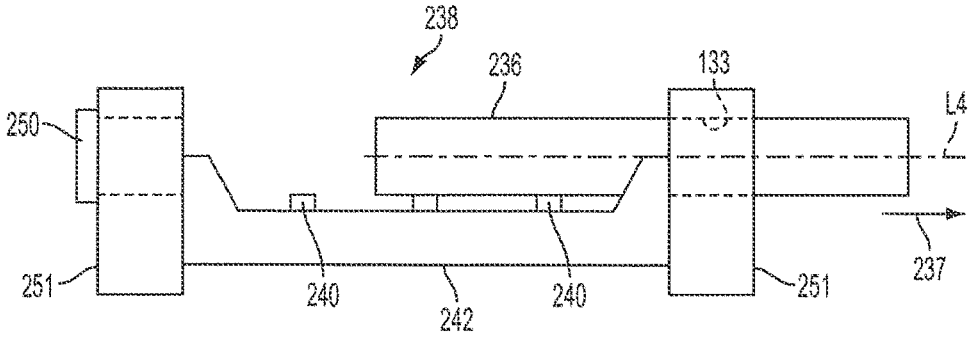

FIGS. 7A-7B show the axial translation of an anvil roll 236 along its longitudinal axis L4. FIG. 7A shows the anvil roll 236 positioned in the operating position. For clarity, various components have been removed (e.g., the bearings, the frame, etc.). The anvil roll 236 is shown supported by cam followers 240. In FIG. 7B, a bearing cap 250 at one end has been removed from the bearing block 251 to expose the opening 133 of the bearing block 251. As described above, the opening 133 may be larger than the outer diameter of the anvil roll 236 thereby allowing the entire anvil roll 236 to pass through the opening 133 via lateral translation along the direction indicated by arrow 237. Once the anvil roll 236 has been removed from the assembly, a replacement anvil roll (not shown) may be inserted into the opening 133 in the bearing block 251 at one end and slid through the anvil assembly 238 into the bearing block 251 at the other end. The lateral translatability of the anvil roll 236 allows the anvil roll 236 to be removed from a rotary cutting apparatus without having to extensively disassemble the apparatus. Additionally, due in part to the relative smaller size of the anvil roll 236, it may be capable of being handled by a single technician.

Figure 8:
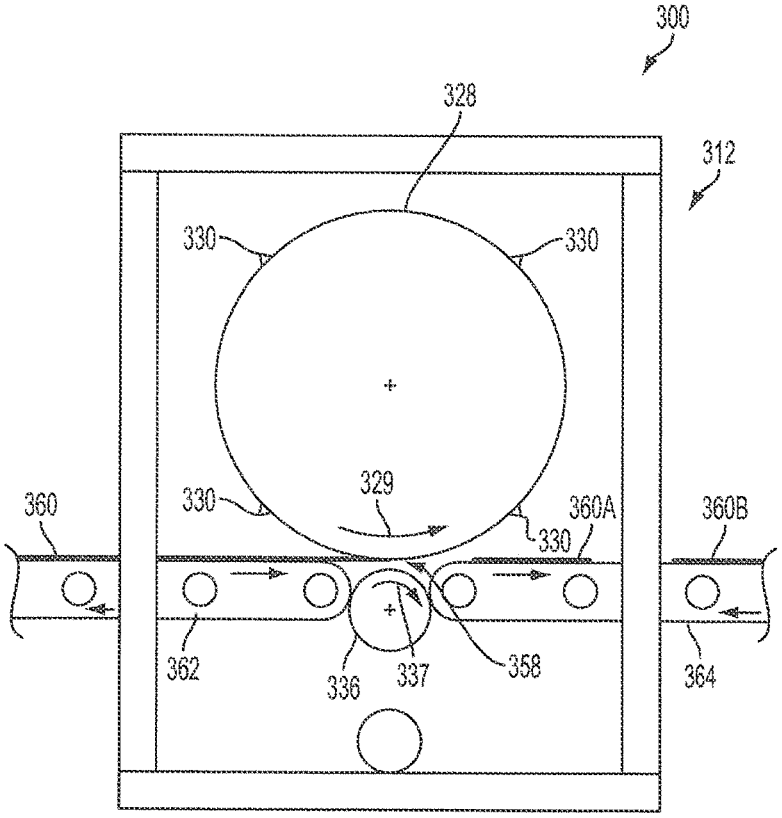
FIG. 8 is a side view of a rotary cutting apparatus according to one non-limiting embodiment with various components removed for clarity.

FIG. 8 is a side view of a rotary cutting apparatus 300 with various components removed for clarity. A die roll 328 rotates in the direction indicated by arrow 329 and an anvil roll 336 rotates in an opposite direction indicated by arrow 337. The anvil roll 336 may rotate faster than the die roll 328, as determined by their relative diameters. The outer surfaces of the die roll 328 and the anvil roll 336 may come in close proximity to form a nip 358. Material, such as a continuous web 360, may be delivered into the nip 358 directly from a first conveyer 362. The material 360 may pass directly from the first conveyer 362 into the nip 358 without the need for an intermediate supporting structure. One of the cutting members 330 positioned around the periphery of the die roll 330 may cut the web of material 360 into discrete articles 330A, 330B, and so forth. The discrete articles 330A, 330B may be passed directly from the nip 358 to a second conveyer 364 without the need for an intermediate supporting structure. Generally, the reduced sizing of the anvil roll 336 allows for a reduction in the transfer distance and a reduction in potential contamination of the web of material 360.

Figure 9:
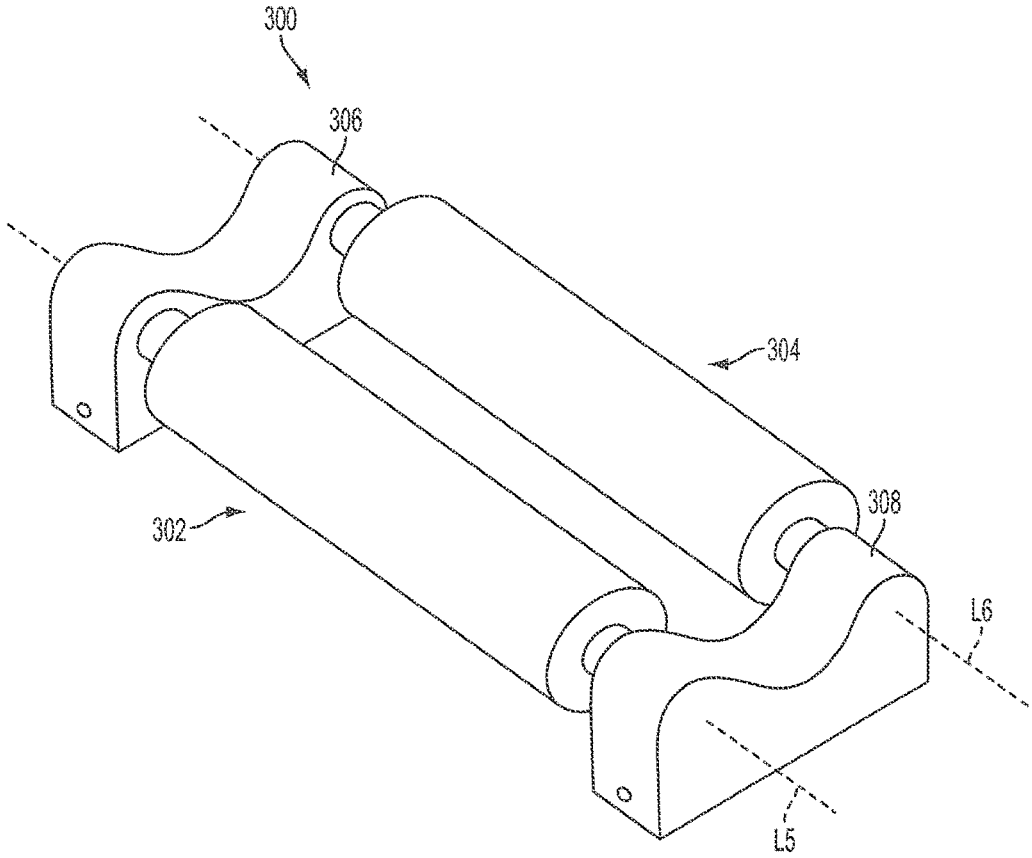
FIG. 9 is a cam follower assembly 300 according to one non-limiting embodiment.

FIG. 9 is one embodiment of a cam follower assembly 300. The cam follower assembly 300 may be positioned with a rotary cutting apparatus to support an anvil roll. The cam follower assembly 300 may comprise a first cam follower 302 and a second cam follower 304. The first cam follower 302 may rotate about a cam follower axis L5 and the second cam follower 304 may rotate about a cam follower axis L6. The cam follower axis L5 and the cam follower axis L6 may be substantially parallel. As illustrated, the first and second cam followers 302, 304 may be elongated (i.e., rollers), but this disclosure is not so limited. Both ends of the first cam follower may have a turned down portion that are each received by a first cam frame 306 and a second cam frame 308, respectively. The second cam follower 304 may be similarly structured. The first and second cam followers 302, 304 may rotate with respect to the first and second cam frames 306, 308 through the use of bearings (not shown) positioned within the first and second cam frames 306, 308, for example. During operation of an associated rotary cutting apparatus, the first and second cam followers 302, 304 may contact an anvil roll to help bear the load exerted on the anvil roll. The first and second cam followers 302, 304 may rotate during the operation of the rotary cutting apparatus due to a frictional engagement between the first and second cam followers 302, 304 and the anvil roll. In some embodiments, a rotary cutting apparatus may comprise two or more cam follower assemblies 300 positioned proximate to the anvil roll. This disclosure is not limited to any particular configuration.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A rotary cutting apparatus, the apparatus comprising:

a frame comprising an opening;

a die roll defining a first longitudinal axis and having an outer circumferential portion comprising a cutting member, wherein the outer circumferential portion has a maximum outer diameter, wherein the die roll is rotatably connected with the frame and configured to rotate about the first longitudinal axis;

a bearer ring connected with the die roll;

an anvil roll having first and second ends, the anvil roll having an outer circumferential surface, wherein the anvil roll is rotatably connected with the frame to define a second longitudinal axis, wherein the anvil roll is rotatable about the second longitudinal axis to cooperate with the die roll to cut material, and wherein the anvil roll is also translatable along the second longitudinal axis, the anvil positioned relative to the die roll such that the bearer ring is in contact with the outer circumferential surface such that the first longitudinal axis is substantially parallel with the second longitudinal axis, wherein the anvil roll has a maximum outer diameter, wherein the maximum outer diameter of the outer circumferential portion of the die roll is at least twice the maximum diameter of the anvil roll;

a cam follower having a cam follower axis, wherein the cam follower is in contact with the anvil roll and configured to rotate about the cam follower axis when the anvil roll rotates; and a first bearing block and a second bearing block, the first and second bearing blocks receiving respective first and second ends of the anvil roll, wherein the anvil roll is selectively removable from the frame and the bearing blocks via translation along the second longitudinal axis through the opening in the frame while supporting the anvil roll with the rotatable cam follower.

2. The rotary cutting apparatus of claim 1, wherein the maximum outer diameter of the outer circumferential portion is at least three times the maximum diameter of the anvil roll.

3. The rotary cutting apparatus of claim 1, wherein the anvil roll has a maximum axial length, wherein the maximum axial length is at least four times the maximum diameter of the anvil roll.

4. The rotary cutting apparatus of claim 1, further comprising:

a first thrust bearing and a second thrust bearing coupled to the respective first and second bearing blocks, the first and second thrust bearings coupled to the respective first and second ends of the anvil roll.

5. The rotary cutting apparatus of claim 1, further comprising:

a cross support frame, wherein the cam follower is coupled to the cross support frame.

6. The rotary cutting apparatus of claim 5, wherein the cross support frame is coupled to the first and second bearing blocks.

7. The rotary cutting apparatus of claim 6, further comprising:

first, second, third and fourth cam followers, each of the first, second, third and fourth cam followers in contact with the anvil roll.

8. The rotary cutting apparatus of claim 7, further comprising:

a first cam frame and a second cam frame, wherein the first and second cam following bearings are rotatably coupled to the first cam frame and the third and fourth cam followers are rotatably coupled to the second cam frame.

9. The rotary cutting apparatus of claim 8, further comprising:

a first cross support frame and a second cross support frame, wherein the first cam frame is coupled to the first and second cross support frames and the second cam frame is coupled to the first and second cross support frames.

10. The rotary cutting apparatus of claim 9, wherein each of the first, second, third and fourth cam following bearings have a respective first, second, third and fourth cam follower axis, wherein the first and third cam follower axes are substantially aligned and the second and fourth cam follower axes are substantially aligned.

11. The rotary cutting apparatus of claim 1, wherein an outer surface of the die roll rotates about the first longitudinal axis at a first rotational speed and an outer surface of the anvil roll rotates about first longitudinal axis at a second rotational speed, and wherein the second rotational speed is at least twice the first rotational speed.

12. A rotary cutting apparatus, the apparatus comprising:

a frame comprising an opening;

a die roll defining a first longitudinal axis and having an outer circumferential portion comprising a cutting member, wherein the outer circumferential portion has a maximum outer diameter, wherein the die roll is rotatably connected with the frame and configured to rotate about the first longitudinal axis;

a bearer ring connected with the die roll;

an anvil roll comprising an outer circumferential surface, wherein the anvil roll is rotatably connected with the frame to define a second longitudinal axis, wherein the anvil roll is rotatable about the second longitudinal axis to cooperate with the die roll to cut material, and wherein the anvil roll is also translatable along the second longitudinal axis, the anvil positioned relative to the die roll such that the bearer ring is in contact with the outer circumferential surface such that the first longitudinal axis is substantially parallel with the second longitudinal axis, wherein the anvil roll has a maximum outer diameter, wherein the maximum outer diameter of the outer circumferential portion of the die roll is at least twice the maximum diameter of the anvil roll; and a cam follower having a cam follower axis, wherein the cam follower is in supporting contact with the anvil roll and configured to rotate about the cam follower axis when the anvil roll rotates; and wherein the anvil roll is selectively removable from the frame via translation along the second longitudinal axis through the opening in the frame while supporting the anvil roll with the cam follower.

13. The rotary cutting apparatus of claim 12, wherein the anvil roll has a maximum axial length, wherein the maximum axial length is at least four times the maximum diameter of the anvil roll.

14. The rotary cutting apparatus of claim 12, further comprising:

a first anvil bearing block having a first opening with a first maximum diameter;

a second anvil bearing block having a second opening with a second maximum diameter, wherein at least one of the first maximum diameter and the second maximum diameter is greater than the maximum diameter of the anvil roll.

15. The rotary cutting apparatus of claim 14, wherein the anvil roll is selectively removable from the frame and the bearing blocks via translation through at least one of the first and second openings.

16. The rotary cutting apparatus of claim 12, further comprising:

a cam frame coupled to the cam follower, wherein the cam follower is rotatable with respect to the cam frame.

* * * * *